US009636527B2

(12) United States Patent
Steger et al.

(10) Patent No.: US 9,636,527 B2
(45) Date of Patent: May 2, 2017

(54) PROTECTIVE BREATHING APPARATUS INHALATION DUCT

(71) Applicant: B/E Aerospace, Inc., Wellington, FL (US)

(72) Inventors: Timothy Steger, Olathe, KS (US); Kevin Bennett, Kansas City, MO (US); Stephen Eastman, Independence, MO (US)

(73) Assignee: B/E Aerospace, Inc., Wellington, FL (US)

( * ) Notice: Subject to any disclaimer, the term of this patent is extended or adjusted under 35 U.S.C. 154(b) by 697 days.

(21) Appl. No.: 14/089,587

(22) Filed: Nov. 25, 2013

(65) Prior Publication Data

US 2014/0150780 A1 Jun. 5, 2014

Related U.S. Application Data

(60) Provisional application No. 61/732,133, filed on Nov. 30, 2012.

(51) Int. Cl.
*A62B 7/08* (2006.01)
*A62B 18/04* (2006.01)
(Continued)

(52) U.S. Cl.
CPC ..... *A62B 7/08* (2013.01); *A62B 18/04* (2013.01); *A62B 18/045* (2013.01);
(Continued)

(58) Field of Classification Search
CPC ..... A42B 3/044; A42B 3/105; A42B 3/288; A62B 17/04; A62B 18/04; A62B 19/00; A62B 21/00; A62B 7/02; A62B 7/08; A62B 7/10; A62B 7/14; A62B 9/00; A62B 9/006; B01J 7/02; B60R 21/2644; F16L 19/0218; F42B 3/04; Y10S 2/901; Y10S 2/906; Y10S 55/17; Y10S 55/35
USPC ..... 128/201.22, 201.23, 201.25, 201.26, 128/202.22, 202.26, 203.21, 204.11, 128/204.18, 205.12, 205.17, 205.23, 128/205.25, 205.28, 205.29
See application file for complete search history.

(56) References Cited

U.S. PATENT DOCUMENTS 3,655,346 A * 4/1972 Cotabish ..... A62B 19/00 128/202.26
3,794,030 A * 2/1974 Cotabish ..... A62B 7/08 128/202.26
(Continued)

FOREIGN PATENT DOCUMENTS

EP 197641 A1 11/1989
GB 2233905 A 1/1991

OTHER PUBLICATIONS

International Search Report, Jul. 16, 2014, 3 pages.

*Primary Examiner* — Annette Dixon
(74) *Attorney, Agent, or Firm* — Shumaker, Loop & Kendrick, LLP

(57) ABSTRACT

An improved protective breathing apparatus having a vent hole or one way valve incorporated into the inhalation duct so that the breathing apparatus can safely vent and release a pressure differential during the opening of the storage bag from vacuum storage. The use of an air pressure relief mechanism prevents the rupture of the duct and preserves the integrity of the device.

9 Claims, 3 Drawing Sheets

(51) Int. Cl.

| | |
|---|---|
| ***A62B 25/00*** | (2006.01) |
| *A62B 7/14* | (2006.01) |
| *A62B 18/10* | (2006.01) |
| *A62B 17/04* | (2006.01) |

(52) U.S. Cl.
CPC ..... *A62B 25/005* (2013.01); *A62B 7/14* (2013.01); *A62B 17/04* (2013.01); *A62B 18/10* (2013.01)

(56) References Cited

U.S. PATENT DOCUMENTS 3,938,512 A * 2/1976 Mausteller ..... F16L 19/0218 128/202.26
3,942,524 A * 3/1976 Li ..... A62B 7/08 128/202.26
3,980,081 A * 9/1976 Cotabish ..... A62B 7/08 128/202.26
4,019,509 A * 4/1977 Li ..... A62B 7/08 128/202.22
4,020,833 A * 5/1977 Rind ..... A62B 7/08 128/202.26
4,172,454 A * 10/1979 Warncke ..... A62B 17/005 128/201.29
4,205,673 A * 6/1980 Wise ..... A62B 21/00 128/202.26
4,212,846 A * 7/1980 Wise ..... A62B 23/02 128/205.28
4,246,229 A * 1/1981 McBride ..... B01J 7/02 128/202.26
4,614,186 A * 9/1986 John ..... A62B 17/04 128/201.25
4,817,597 A * 4/1989 Tanaka ..... A62B 7/08 128/205.17
5,113,854 A 5/1992 Dosch et al.
5,267,558 A * 12/1993 Haertle ..... A62B 21/00 128/202.26
2011/0277768 A1 11/2011 Hill et al.
2014/0014098 A1* 1/2014 Elliott ..... A62B 7/08 128/201.23
2014/0014099 A1* 1/2014 Elliott ..... A62B 9/006 128/201.23

* cited by examiner

FIG. 3A
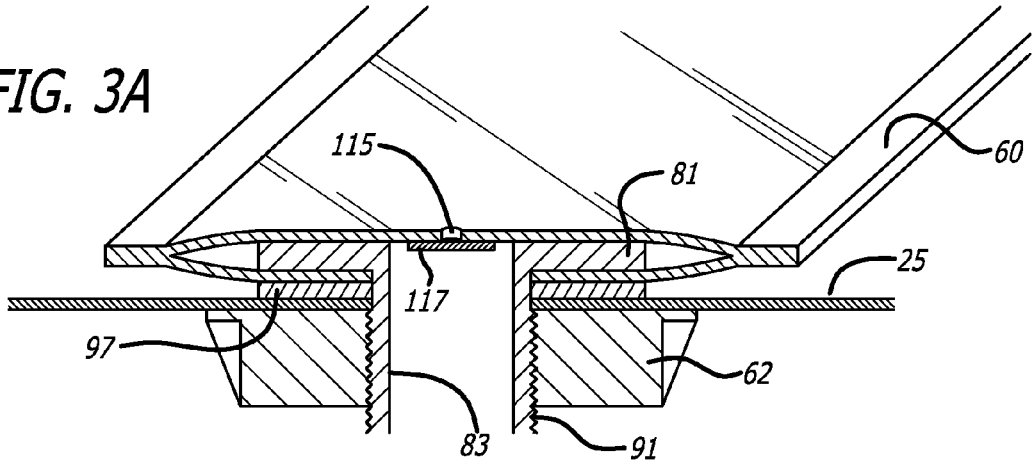
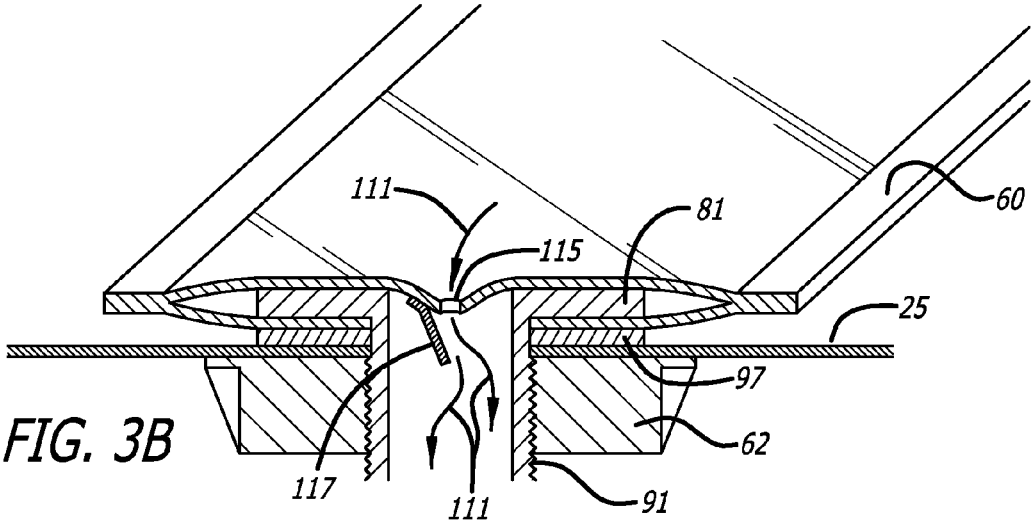
FIG. 3B
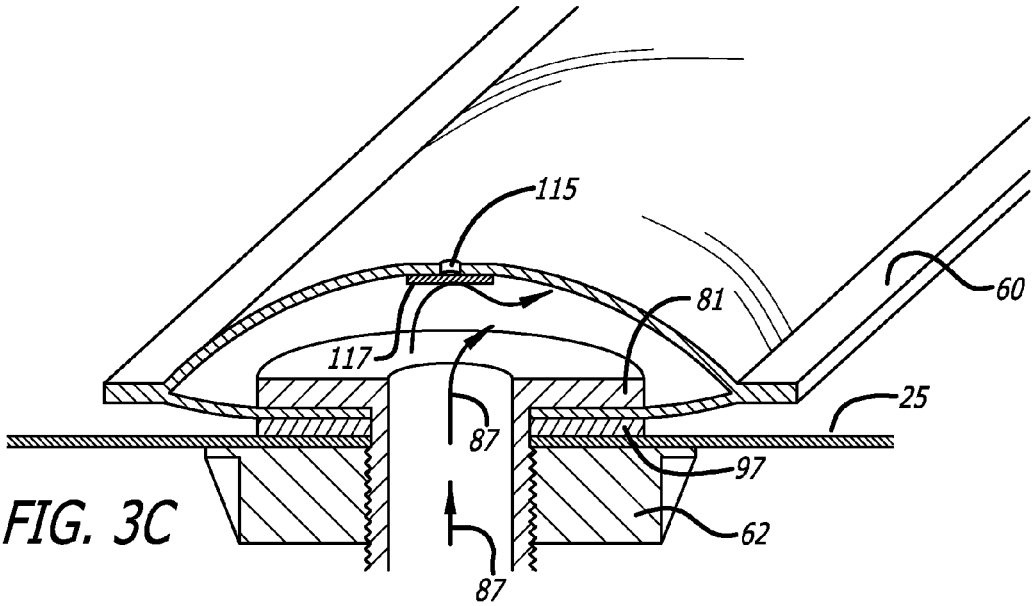
FIG. 3C

PROTECTIVE BREATHING APPARATUS INHALATION DUCT

CROSS-REFERENCES TO RELATED APPLICATIONS

This application claims priority from U.S. Application No. 61/732,133, filed Nov. 30, 2012, incorporated herein by reference in its entirety.

BACKGROUND

Oxygen masks are well known in the art as a tool for fighting fires in an enclosed structure. A portable oxygen mask that can provide a steady and controlled stream of oxygen while maintaining a weight that allows for freedom of movement is a necessity when fighting fire. This need is never more prevalent than in the confined and pressurized environment of an aircraft. An aircraft fire presents many additional dangers due to its pressurized compartments and the presence of oxygen in large quantities. Therefore, there is a need for a reliable and compact oxygen mask that is light weight and well suited for all closed environments, particularly those of an aircraft.

The Protective Breathing Equipment (PBE) is a closed circuit breathing apparatus designed to help protect the wearer's eyes and respiratory tract in an atmosphere containing smoke and fumes by isolating the eyes and breathing functions from the environment. Isolation is achieved by a hood system that envelops the head of the wearer. A breathable atmosphere is maintained by a demand-based chemical air regeneration system that supplies oxygen and removes carbon dioxide and water vapor. This equipment is certified in accordance with the requirements of TSO-C116.

The PBE is a hood device that completely encloses the head of the wearer and seals at the neck with a thin elastic membrane. The large internal volume of the hood accommodates glasses and long hair while the elastic membrane neckseal enables fitting over the broad population range representative of aircraft crewmembers. The chemical air regeneration system is based on the use of potassium superoxide (KO2). Operation of the PBE is silently and reliably powered by the exhalation of the wearer into an oronasal mask cone located within the hood. The low moisture content of the oxygen gas generated by the KO2 bed in the canister reduces the wet bulb temperature, improves wearer comfort, and controls misting or fogging of the visor, side windows, and/or glasses. The complete device is secured to the head to minimize restrictions to mobility. The large optically clear visor and side windows provide a wide field of vision while maintaining their relative position with the head. A neck shield extends downward from the back of the hood to protect the collar and upper shoulder area of the user from direct flame contact. A speaking diaphragm is installed in the oronasal mask cone to enhance communication.

Protective breathing apparatus (PBE) for use on aircraft are stored in sealed bags to ensure that they are free of moisture and carbon dioxide. When the device is needed, it is removed from its storage location and the sealed bag is opened. The user then deploys the PBE over his or her head and shoulders and initiates the oxygen generation unit. An exemplary PBE is shown in FIG. 1. During operation, the user exhales into the oronasal mouthpiece. The exhaled breath travels through an exhalation duct and enters a canister containing $KO_2$ (potassium superoxide). The exhaled carbon dioxide and water vapor are absorbed and replacement oxygen is released according to the reaction below:

$$2KO_2+H_2O \rightarrow 2KOH+1.5O_2$$

$$2KO_2+CO_2 \rightarrow K_2CO_3+1.5O_2 \qquad \text{Oxygen Generation:}$$

$$2KOH+CO_2 \rightarrow K_2CO_3+H_2O$$

$$KOH+CO_2 \rightarrow KHCO_3 \qquad \text{Carbon Dioxide Removal:}$$

The regenerated oxygen gas passes through the inhalation duct and enters the main compartment, or breathing chamber, of the PBE hood. The interior hood volume above the neck seal membrane serves as the breathing chamber. When the user inhales, the one-way inhalation valve allows the regenerated gas to enter the oronasal mouthpiece and thus travel to the respiratory tract of the user. The breathing cycle can continue in this manner until the $KO_2$ canister is exhausted.

In the event of a fire on the aircraft, the PBE is removed from storage and is quickly transitioned from a vacuum environment inside its storage bag to the nominal environment of the aircraft cabin. The rapid pressure increase can affect the components of the PBE, and in particular can stretch, deform, or rupture the exhalation duct. That is, while the canister is still largely in the predominantly vacuum environment of its storage, the pressure differential between the canister and the outside is nil. However, once the bag is opened, a large pressure differential across the diaphragm can be created by the ambient pressure outside and the vacuum inside. This pressure differential across the membrane can draw the inhalation duct into the canister, leading to stretching, tearing, and deformation. Any of this type of damage to the exhalation duct can significantly reduce the duration of the PBE's effectiveness.

SUMMARY OF THE INVENTION

To prevent damage to the PBE as it transitions from the vacuum storage bag to the open environment, an improved protective breathing apparatus is disclosed having a vent hole or one way valve incorporated into the inhalation duct so that the canister can safely vent and release the pressure differential during the opening of the storage bag. The use of an air pressure relief mechanism prevents the rupture of the duct and preserves the integrity of the PBE and prevents damage to the exhalation duct.

BRIEF DESCRIPTION OF THE DRAWINGS

FIG. 3A is an enlarged cross sectional view of the inhalation duct at the canister interface;

FIG. 3B is an enlarged cross sectional view of the valve opening under a pressure differential at the canister interface;

FIG. 3C is an enlarged cross sectional view of the valve closed as oxygen is delivered through the inhalation duct from the canister.

DETAILED DESCRIPTION OF THE PREFERRED EMBODIMENTS

Figure 1:
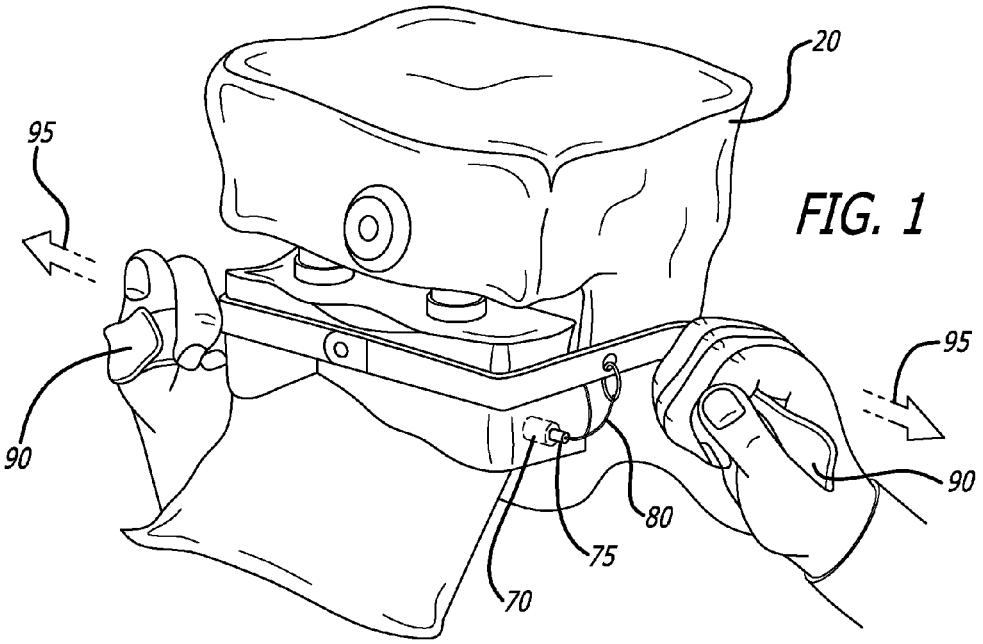
FIG. 1 is an elevated rear perspective view of a first preferred embodiment of the present invention.
Figure 2:
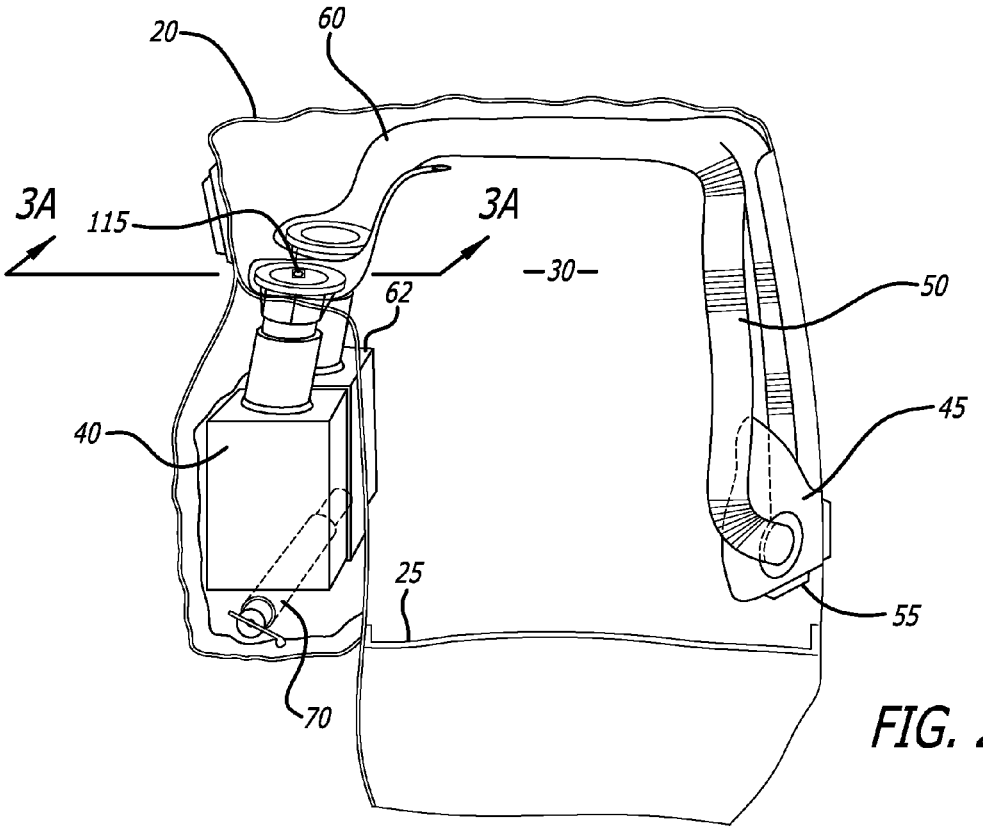
FIG. 2 is a side view, cut away, of the embodiment of FIG. 1.
Figure 4:
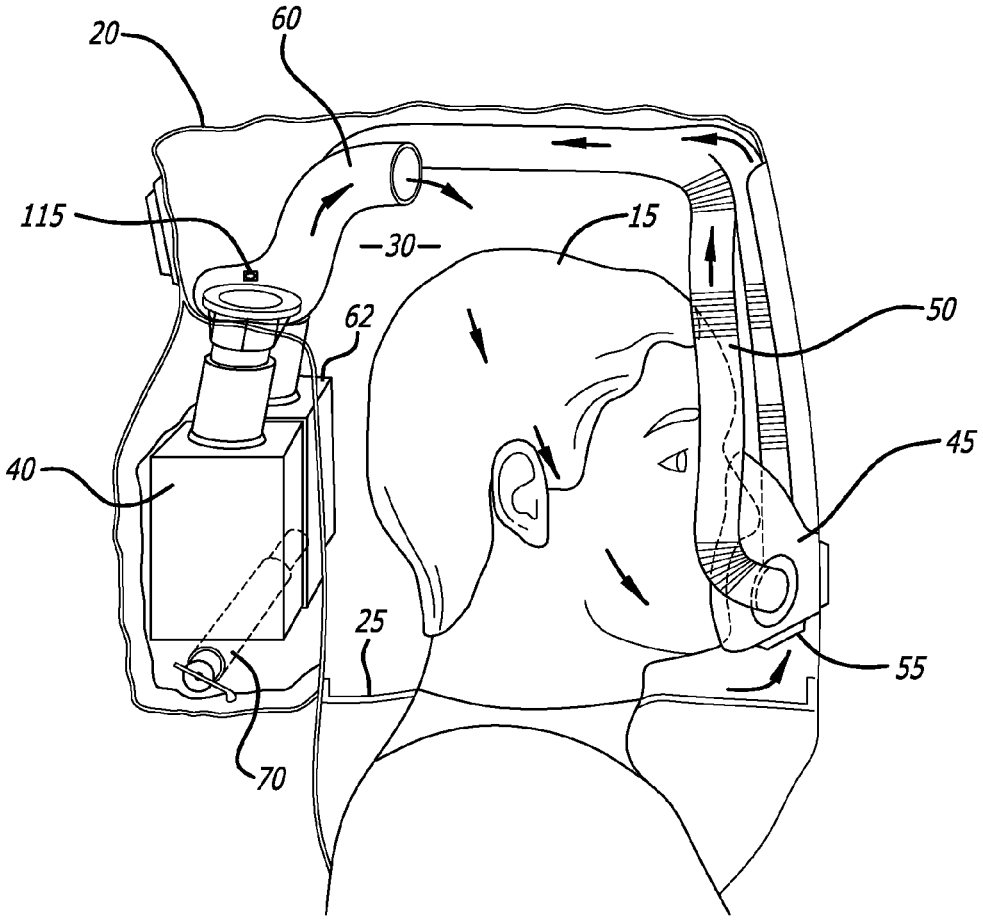
FIG. 4 is a side view, cut away, of the embodiment of FIG. 1 with air/oxygen flowing through the inhalation duct.

The protective breathing equipment, or PBE, of the present invention is generally shown in FIGS. 1, 2, and 4. A hood 20 is sized to fit over a human head 15, and includes a substantially airtight neck seal membrane 25 that the head 15 is slipped into and forms a seal to prevent gases or smoke from entering the breathing chamber 30. Behind the user's head 15 is an oxygen generating system 40 described in more detail below. An oronasal mouthpiece 45 allows oxygen supplied from an inhalation duct 60 to enter through a one-way inhalation valve 55, while carbon dioxide expelled from the user is routed back to the oxygen generating system 40 via an exhalation duct 50. Oxygen is produced in a chemical reaction and is communicated from the oxygen generating system 40 contained in a canister 62 through an inhalation duct 60 to the mouthpiece 45 or the breathing chamber 30 generally.

During operation, the user exhales carbon dioxide into the oronasal mouthpiece 45. The exhaled breath travels through the exhalation duct 50 and enters the canister 62 containing $KO_2$ (potassium superoxide). The exhaled carbon dioxide and water vapor are absorbed and replacement oxygen is released according to the reaction below:

$$2KO_2+H_2O \rightarrow 2KOH+1.5O_2$$

$$2KO_{2+CO2} \rightarrow K_2CO_3+1.5O_2 \qquad \text{Oxygen Generation:}$$

$$2KOH+CO_2 \rightarrow K_2CO_3+H_2O$$

$$KOH+CO_2 \rightarrow KHCO_3 \qquad \text{Carbon Dioxide Removal:}$$

The regenerated oxygen gas passes through the inhalation duct 60 and enters the main compartment, or breathing chamber 30, of the hood 20. The interior hood volume above the neck seal membrane 25 serves as the breathing chamber 30. When the user inhales, the one-way inhalation valve 55 allows the regenerated gas to enter the oronasal mouthpiece 45 and thus travel to the respiratory tract of the user. The breathing cycle will continue until the $KO_2$ canister 62 is exhausted.

The PBE can quickly be donned in the event of a cabin fire by air crew in order to combat the fire. The present invention is particularly well suited to protect the user from the hazards associated with toxic smoke, fire and hypoxia. The hood 20 has a visor 180 to protect the user's eyes and provides a means for continued breathing with a self-contained oxygen generating system 40. In a preferred embodiment, the system has a minimum of 15 minutes of operational life and is disposed of after use.

The PBE hood operation is described in more detail below. During the donning sequence, the user actuates a chlorate starter candle 70 by pulling the adjustment straps 90 in the direction indicated by arrows 95, thereby securing the oronasal mouthpiece 45 against the user's face. The chemical reaction of the starter candle 70 is shown below:

$$2NaClO_3+Heat \rightarrow 2NaCl+30_2 \qquad \text{Exothermic}$$

The small chlorate candle 70 (starter candle) produces about 8 liters of oxygen in 20 seconds by the chemical decomposition of sodium chlorate. This candle 70 is mounted to the bottom of the $KO_2$ canister 62. The starter candle 65 is preferably actuated by pulling a release pin 75 that is deployed automatically by a lanyard 80 when the user adjusts the straps 90 that tension the oronasal mouthpiece against the user's face. The gas of the starter candle 70 discharges into the $KO_2$ canister 62 on the side where exhaled breath enters the canister from the exhalation duct 50. Some of the oxygen from the starter candle 70 provides an initial fill of the exhalation duct, while the bulk of this oxygen travels through the $KO_2$ canister 62 and fills the main compartment 30 of the hood 20.

For use on an aircraft, the PBE of the present invention is preferably vacuum sealed and stored at designated locations within the aircraft. Since the active air regeneration chemical ($KO_2$) is moisture sensitive, the primary function of the vacuum-sealed bag is to maintain an effective moisture barrier. Loss of vacuum resulting in slight inflation of the bag is an indication of the loss of the moisture barrier, requiring replacement of the unit. However, as set forth below the transition from the vacuum sealed protective storage bag to the environment has led to damage to the unit, necessitating the present invention.

When the PBE is used by the aircraft crew, it is opened and returned from a vacuum atmosphere quickly. With that quick return to pressure, a rupture to the inhalation duct may result from its proximity to, and being sucked into, the canister (see FIG. 2), leading to tears and deformation in the air conduit. If the inhalation duct has been torn, it could reduce the runtime of the PBE assembly. This pressure differential when the canister 40 is at vacuum can pull the thin walled exhalation duct 50 into the canister 62 until it stretches and with enough stretching a hole could be created. Here, the exhalation duct is drawn into the opening in the canister by the vacuum existing in the canister 62.

To overcome this problem, FIG. 3 illustrates a hole 115 in the inhalation duct 60 adjacent the canister 62, which can be used to vent the canister 62 through the inhalation duct 60 once the PBE 20 is removed from the airtight packaging. In an alternative embodiment, the hole 115 can include a one-way valve comprising a hole 115 and a flap 117 adjacent the hole 115, heat sealed or otherwise attached so that the flap 117 can releasably seal the inhalation duct 60. The one-way valve allows air into the inhalation duct during venting, but resists air entering the inhalation duct during breathing mode. With the modification of adding a vent hole 115 or one way valve plastic flap 117 to the inhalation duct 60, the canister 62 can safely release the pressure differential during the opening of the vacuum stowage bag. Thus, the opportunity for the thin-walled exhalation duct to be deformed, stretched, or ruptured is significantly reduced as the system reaches equilibrium with the ambient pressure.

FIGS. 3*a*-3C illustrate the inhalation duct 60 at the interface with the canister 62. The inhalation 60 duct is a flat, lightweight tubing made of two sheets of thin plastic. The duct 60 is placed over a flange 81 having a longitudinal opening 83 leading to the oxygen generating system 40. Oxygen flows in the direction of arrows 87 (FIG. 3C) through the inhalation duct and into the interior of the mask, where it is breathed by the user. The flange 81 includes outer threads 91 that engage with inner threads on the canister 62, forming an airtight seal. The flange 81 when tightened against the canister 62 captures the neck membrane 25 along with a silicon washer 97. FIG. 3A illustrates the condition of the inhalation duct 60 during storage in the vacuum state. The portion of the duct 60 adjacent the interface with the canister is flush against the opening of the flange 81. Because the entire mask is in vacuum pack, there is no pressure differential across the duct 60 and the interface is in equilibrium.

Immediately after the mask has been released from its packing and the vacuum broken, the pressure outside the canister 62 is larger than the pressure inside the canister 62, which has not had an opportunity to vent. Without hole 115, the pressure would cause a portion of the inhalation duct to be sucked into the canister, leading to potential tearing and deformation of the duct 60. However, as shown in FIG. 3B, air (designated by arrows 111) pass through the hole 115 in the duct 60 into the canister 62, equalizing the pressure across the inhalation duct/canister interface and venting the canister. The hole 115 prevents the inhalation duct 60 from being drawn into the canister, preserving the integrity of the duct. The flap 117 is attached on the inside of the duct 60, such that it permits air to enter the duct by separating from the surface of the duct as shown in FIG. 3B. Thus, the flap 117 acts as a one way valve to allow air to pressurize the canister.

Once the canister and mask are fully pressurized, and the oxygen generating system 40 activated, oxygen flows from the canister 62 through the flange 81 and into the inhalation duct 60 where it fills the mask. In position of the flap 117 prevents oxygen from exiting the inhalation duct at the flange by closing the hole 115 upon pressurization from the flowing oxygen or the bias of the flap 117 against the surface of the inhalation duct. Thus, oxygen is not diverted by the presence of the hole 115, and the mask operates normally as intended.

The venting mechanism of the present invention reduces the stress on the inhalation duct 60 by preventing distortion or tearing due to the pressure differential across the duct when the apparatus is brought out of vacuum. Air quickly enters through the hole 115 and pressurizes the canister 62, minimizing the unbalance in pressure.

It will be apparent from the foregoing that while particular forms of the invention have been illustrated and described, various modifications can be made without departing from the spirit and scope of the invention. Accordingly, it is not intended that the invention be limited, except as by the appended claims.

We claim:

1. A self-contained breathing apparatus for providing emergency oxygen and adapted for storage in a vacuum-sealed condition until use, comprising:

(a) a transparent flexible hood adapted to cover the head of the wearer, including an annular seal carried by one end of the hood for sealing the hood around the neck of the wearer during use;

(b) an oxygen-generating canister positioned in the hood, including a starter for initiating a oxygen-producing chemical reaction upon manual activation;

(c) an oronasal mask connected in a pneumatic circuit by an inhalation duct and an exhalation duct to the canister for delivering oxygen to the wearer and returning exhaled gases to the canister; and (d) a port positioned in the inhalation duct between the canister and the mask inside the hood for allowing entry into the inhalation duct of air exterior to the hood when air pressure exterior to the hood is greater than the air pressure inside the hood prior to use.

2. A self-contained breathing apparatus according to claim 1, wherein the port in the inhalation duct includes a flap positioned over the port and movable between a closed position over the port wherein air is prevented from passing from a location exterior to the inhalation duct into the inhalation duct during use, and an open position with the flap positioned away from the port to allow ambient air to pass into the inhalation duct through the port.

3. A self-contained breathing apparatus according to claim 1, wherein the inhalation duct is formed of two flat strips joined along spaced-apart, longitudinally-extending edges that are adapted to separate and form an oxygen flow path during oxygen flow from the canister.

4. A self-contained breathing apparatus according to claim 1, wherein the oronasal mask includes a one-way inhalation valve positioned in the mask interior to the hood and communicating for oxygen flow with an opening in the inhalation duct interior to the hood.

5. A self-contained breathing apparatus according to claim 1, wherein the canister is positioned in the hood in a position posterior to the wearer when in use, and further wherein the inhalation duct delivers oxygen to the wearer from a position posterior to the wearer when in use.

6. A self-contained breathing apparatus according to claim 1, wherein the exhalation duct comprises first and second exhalation duct segments communicating with opposing sides of the mask.

7. A self-contained breathing apparatus according to claim 1, and including first and second exhalation duct segments communicating with opposing sides of the mask to a position above the head of the wearer and a unitary exhalation duct extending from the position above the head of the wearer to the canister.

8. A self-contained breathing apparatus for providing emergency oxygen and adapted for storage in a vacuum-sealed condition until use, comprising:

(a) a transparent flexible hood adapted to cover the head of the wearer, including an annular seal carried by one end of the hood for sealing the hood around the neck of the wearer during oxygen-generating use;

(b) an oxygen-generating canister positioned in the hood, including a starter for initiating a chemical oxygen-producing reaction upon manual activation;

(c) an oronasal mask including a one-way inhalation valve positioned in the mask interior to the hood and communicating for oxygen flow with an opening in the inhalation duct interior to the hood; and (d) a one-way valve positioned in the inhalation duct between the canister and the mask inside the hood and movable by differential air pressure between a closed position wherein air is prevented from passing from a location exterior to the inhalation duct into the inhalation duct during use, and an open position that allows ambient air to pass into the inhalation duct through the valve when air pressure exterior to the hood is greater than the air pressure inside the hood prior to use.

9. A self-contained breathing apparatus according to claim 8, and including first and second exhalation duct segments communicating with opposing sides of the mask to a position above the head of the wearer and a unitary exhalation duct extending from the position above the head of the wearer to the canister.

* * * * *